US005203571A

United States Patent [19]

Fischer

[11] Patent Number: 5,203,571

[45] Date of Patent: Apr. 20, 1993

[54] GAME BOARD

[76] Inventor: Roland Fischer, Aldringenstrasse 11, D 8000 Munich 19, Fed. Rep. of Germany

[21] Appl. No.: 895,329

[22] Filed: Jun. 8, 1992

[30] Foreign Application Priority Data

Jun. 8, 1991 [DE] Fed. Rep. of Germany ..... 9107064

[51] Int. Cl.[5] ..... A63F 3/02

[52] U.S. Cl. ..... 273/286

[58] Field of Search ..... 273/286, 285, 287

[56] References Cited

U.S. PATENT DOCUMENTS

| | | | |
|---|---|---|---|
| 1,269,276 | 6/1918 | Harris | 273/286 |
| 2,667,353 | 1/1954 | Lancie | 273/286 |
| 3,948,528 | 4/1976 | Goodman et al. | 273/286 |
| 4,848,772 | 7/1989 | Lewis et al. | 273/286 |

FOREIGN PATENT DOCUMENTS

| | | | |
|---|---|---|---|
| 116825 | 6/1918 | United Kingdom | 273/286 |

*Primary Examiner*—Benjamin H. Layno
*Attorney, Agent, or Firm*—Collard & Roe

[57] ABSTRACT

A game board made of a flexible material, whereby a pocket (28) for receiving the pieces (30) is arranged on a first edge (14) of the game board (10) and the other edges (16, 18, 20) are embodied in the form of pockets (40) with openings (42) for receiving reinforcing bars (44), and whereby provision is made on the respective ends of the edges (14, 16, 18, 20) for closing elements (36) with corresponding locking elements (38) for arranging the edges vertically relative to the game board (10).

10 Claims, 4 Drawing Sheets

GAME BOARD

DESCRIPTION

The invention relates to a game board made of a flexible material.

Such a game board is known, for example as a chessboard made of linoleum. With this known game board, the pieces or chessmen always have to be carried along in a special container. This is inconvenient and poses the risk that either the game board or the container are forgotten or getting lost, which makes the game unusuable. Rigid game boards require much space and, for that reason, are mostly not carried out for leisure-time activities.

It is, therefore, the problem of the present invention to further develop a game board of the type specified above in such a way that a fixed association of the game board and pieces or figures is always assured. At the same time, the flexible game board has to have an adequate stability.

Said problem is resolved by the invention characterized in claim 1, i.e., by a game board made of a flexible material, said board being characterized in that a pocket for receiving pieces is arranged on a first edge of the game board, whereby the other edges are embodied in the form of pockets for receiving reinforcing bars, and whereby provision is made at the ends of the edges for closing elements with corresponding locking elements for vertically arranging the edges with respect to the game board.

By mounting the pocket on a first edge of the game board, the required figures or pieces are always available to the players, and cannot be forgotten or lost. Furthermore, the game board according to the invention has a highly compact shape for the transport. By arranging reinforcing bars in the edges of the game board and subsequently setting up and locking the edges, a box-like game board is created having a higher stability compared to the known game board, which prevents the penetration of impurities such as, for example, sand. Moreover, with the game board according to the invention, a strip-like edge is created conforming to an edge of a rigid game board, so that when the dice are thrown, the latter will remain within the field of the game board.

By arranging the pocket and the closing elements on opposite edges of the game board, it is possible to roll up the game board around the pocket, and to lock it, which results in an extremely convenient and space-saving arrangement. As mentioned above, games are frequently not carried along for leisure-time activities because of their size. This problem is resolved by the invention in an advantageous way.

Advantageous embodiments of the invention are defined in the dependent claims.

For example, provision is made that at least one closing element is arranged on the second edge of the game board disposed opposite the pocket. In this way, the game board can be easily locked when it is in its rolled-up condition.

According to another advantageous embodiment of the invention, provision is made that the pocket has a cylindrical form and extends across the entire length of the first edge. This permits a convenient arrangement of the pieces and creates a roll for rolling the game board together.

According to another advantageous embodiment of the invention, provision is made that the closing element is embodied in the form of a strap extending perpendicular to the second edge, whereby locking elements are arranged on the two ends of the strap. This permits safe sealing of the rolled-up game board.

According to yet another beneficial embodiment, the locking elements are embodied in the form of snap fasteners. Also, it is conceivable to embody the locking elements in the form of a burlike strip clasp closure.

Another beneficial feature is that the pocket is sealable. This prevents any penetration of sand and the like, which would scratch the pieces in the long term.

As the game board is flexible, it can be rolled around the pocket and fixed by means of the closing elements. Leather or a plastic foil can be considered as material for the flexible game board.

An exemplified embodiment of the invention is shown in the drawing and explained in greater detail in the following. In the drawing, FIG. 1 is a top view of the game board in the rolled-out condition;

Figure 1:
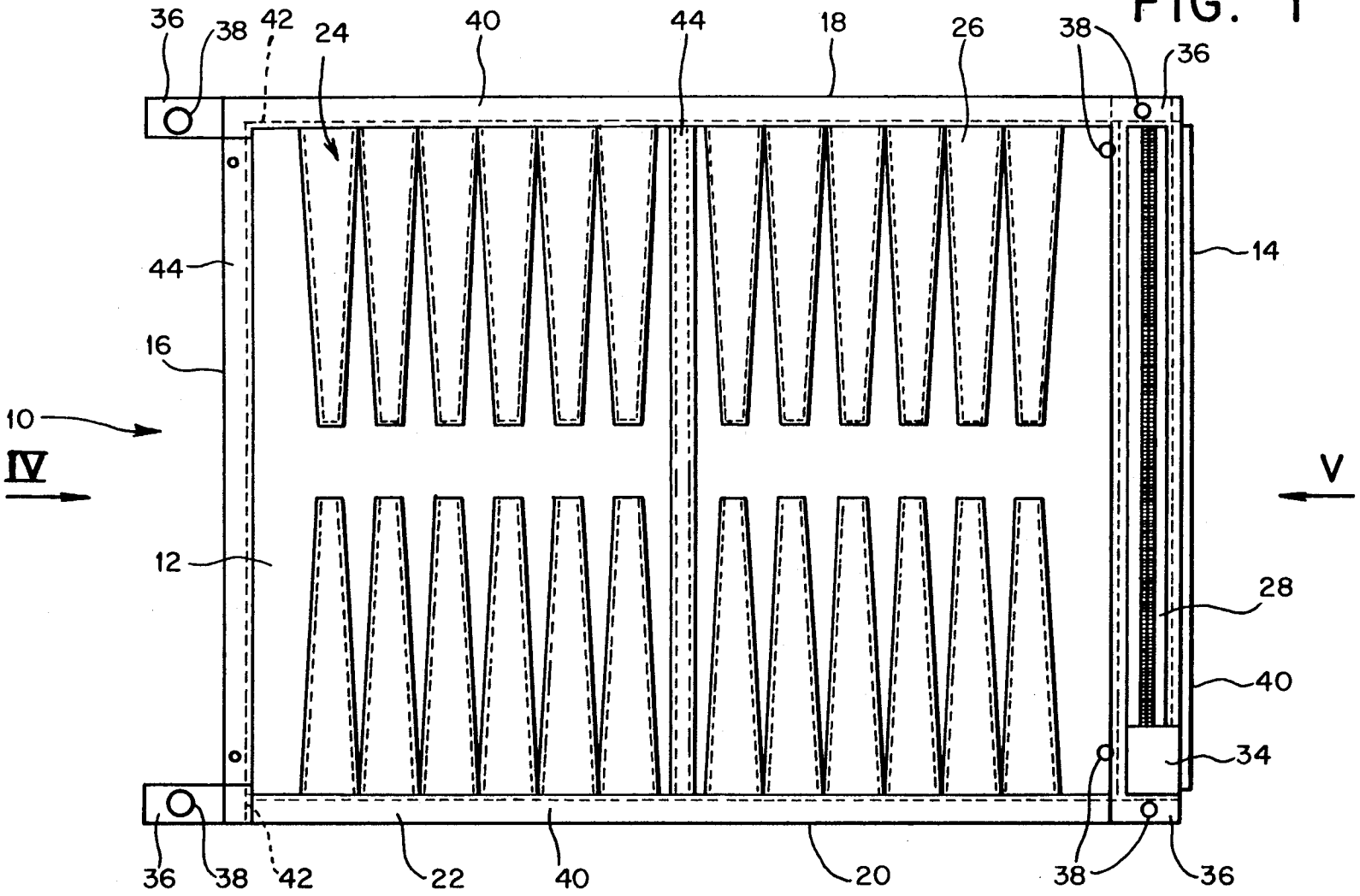
Figure 2:
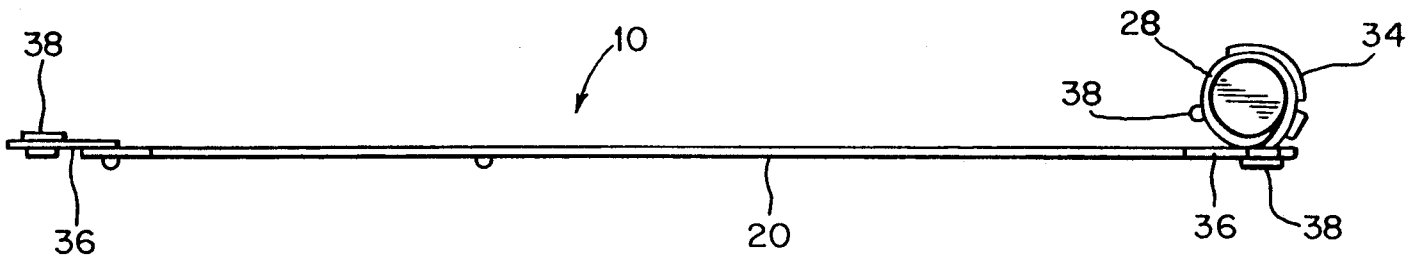
FIG. 2 shows a lateral view of the game board in the rolled-out condition.
Figure 4:
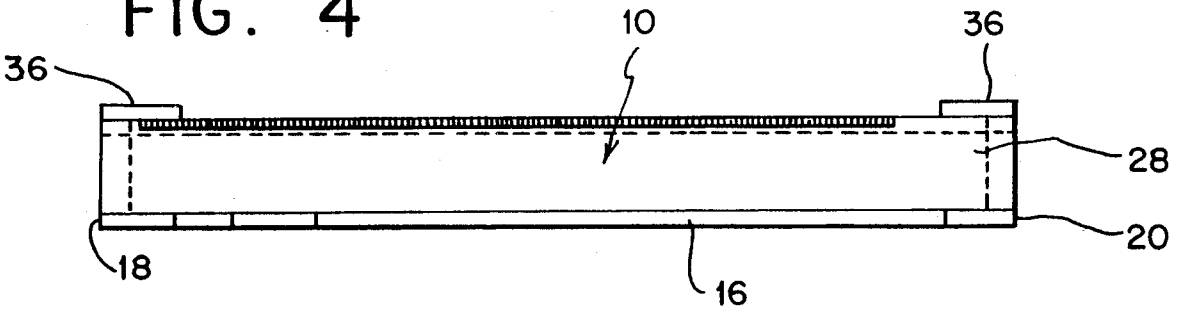
FIG. 4 is a view of the rolled-out game board in the direction of arrow IV in FIG. 1.
Figure 5:
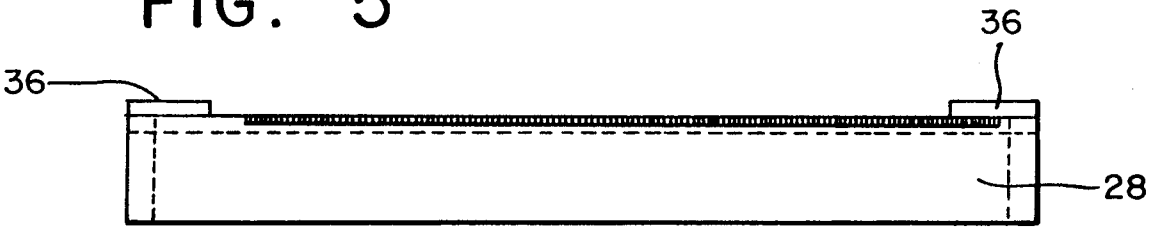
FIG. 5 is a view of the rolled-out game board in the direction of arrow V in FIG. 1.
Figure 3:
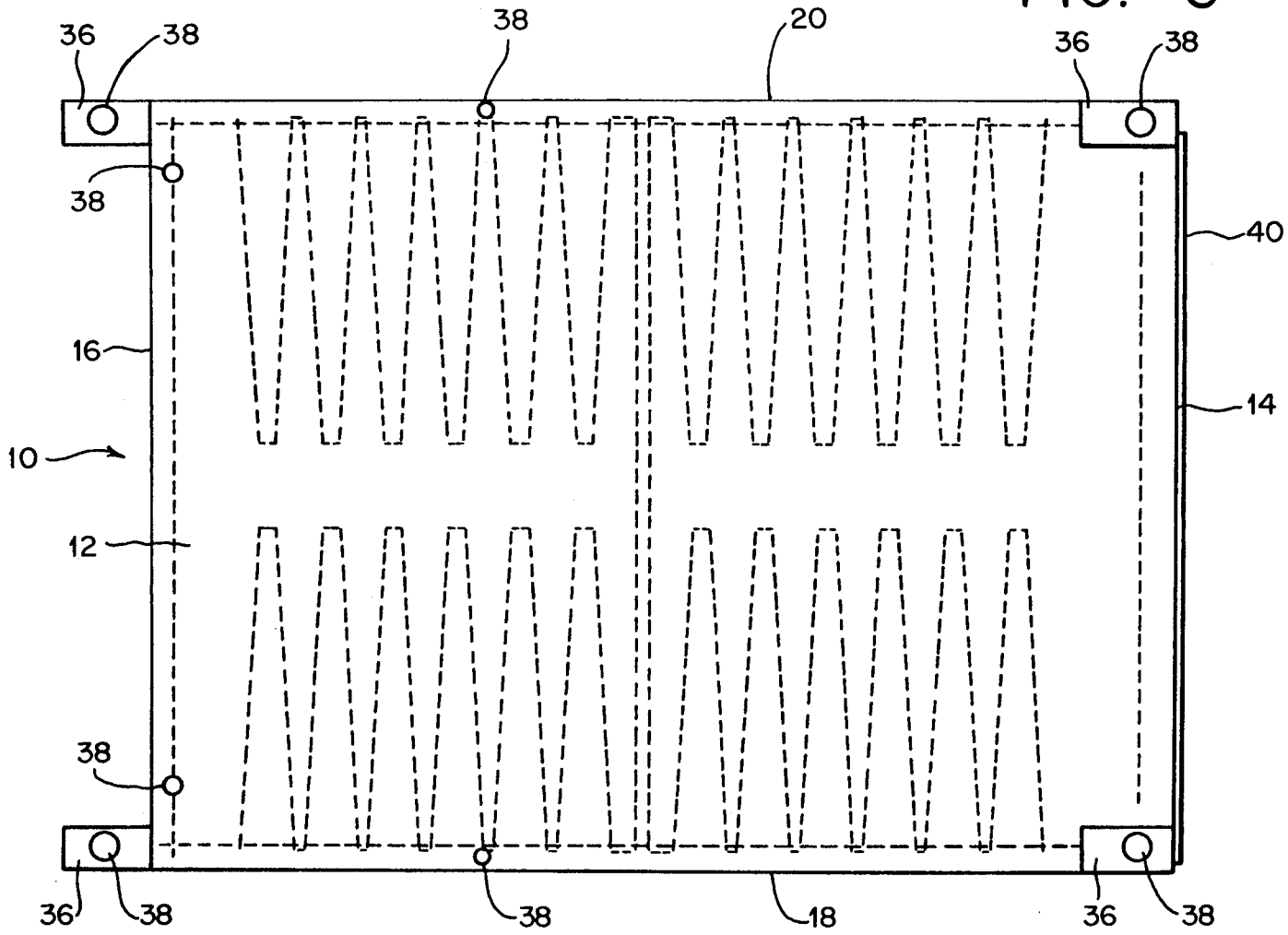
FIG. 3 shows the rolled-out game board from the bottom.
Figure 7:
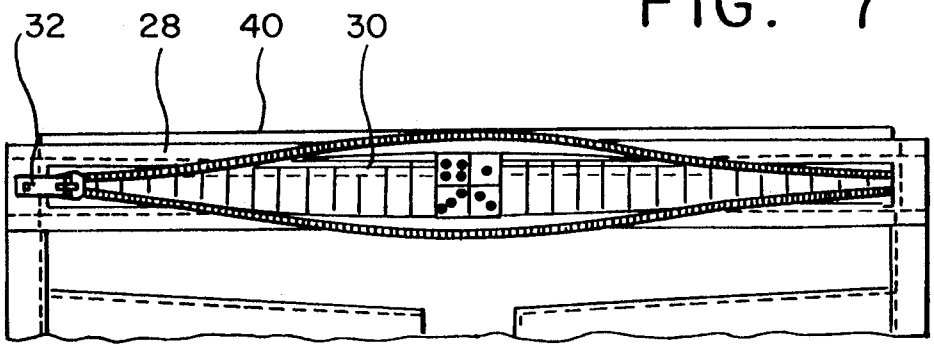
FIG. 7 is a top view of the open pocket with the pieces arranged therein.
Figure 8:
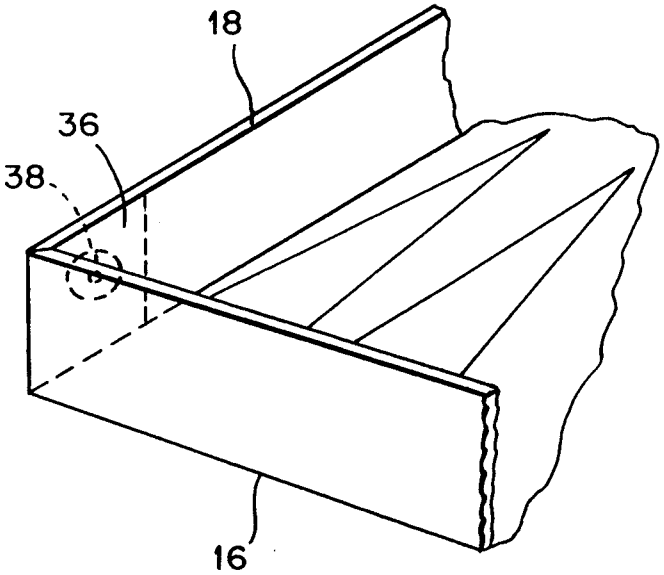
FIG. 8 is a perspective view of one corner of the game board.

The game board 10 shown in the drawing is a backgammon board consisting of a preferably rectangular basic body 12 made of a flexible material such as, for example, plastic foil or leather. The basic body 12 has the four edges 14, 16, 18, 20, with provision being made for a rigidly arranged reinforcing bar 44 in the edge 16 in order to provide the game board 10 in the rolled-out condition with the required stability. For the purpose of increasing the stability, provision is made in the lateral edges 18 for the 20 pockets 40 with the openings 42, so that additional reinforcing bars 44 can be inserted in the pockets 40 of the rolled-out game board. For the purpose of forming the individual fields 24 of the game board 10, the latter can be imprinted or provided with the attachments 26 made of colored, flexible material such as, for example, plastic foil or leather. Said attachments 26 can be sewn or glued to the board.

A first pocket pocket 28 for receiving the pieces 30 and dice etc. is arranged on a first edge of the game board 10. In the embodiment shown, the pocket 28 has a cylindrical shape; however, it may have any suitable form. The pocket 28 is sealable by means of a zipper 32 and has a gripping flap or pull strap 34 at the one end. However, any suitable type of closing device such as, for example, a bur-type strip closure or snap fasteners may serve as the closing device. On the outer side of the pocket 28, provision is made for two additional pockets 40 for receiving the reinforcing bars 44 when the game board 10 is rolled up.

The closing elements 36 in the form of straps preferably made of the same material as the game board 10 are arranged on the respective ends of the edges 14, 16, 18, 20. The straps are are fitted with the locking elements 38 in the form of snap fasteners. However, the locking elements may be of any desired design. For example, the locking elements 38 may consists of a bur-type strip closing device or the like. When the edges 16, 18, 20 with the reinforcing bars arranged therein are set up, i.e., arranged vertically by pulling them toward the game board 10, the closing elements 36 are pivoted by 90 degrees and the associated locking elements 38 are engaged with one another. In this way, a corner connection is created, which gives the game board 10 the form of a stable box. The drawing shows that another reinforcing bar 44 can be arranged in the center of the game board 10.

Figure 6:
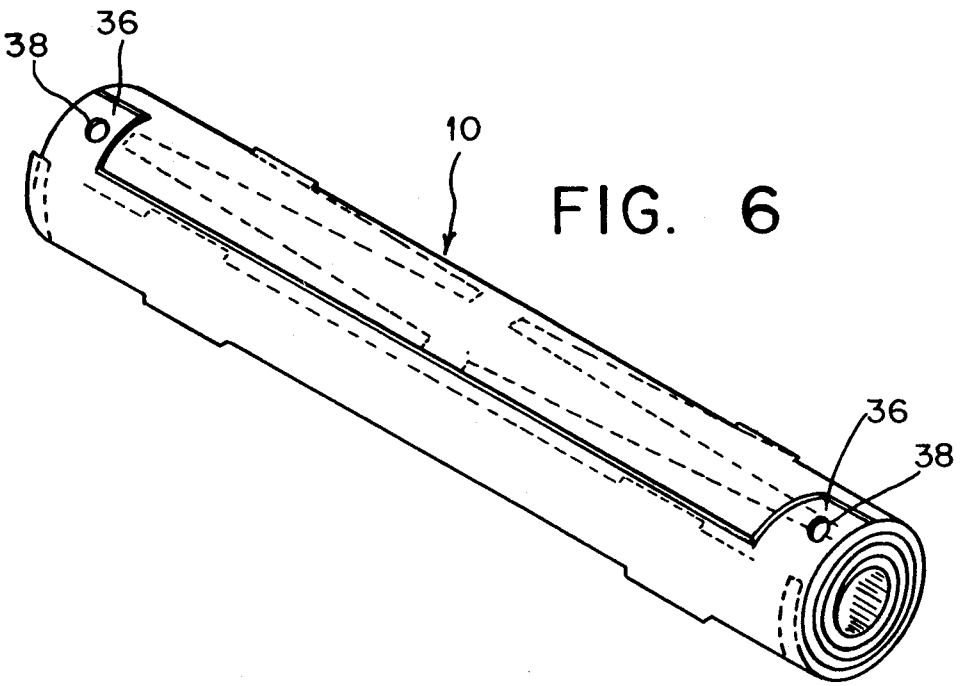
FIG. 6 is a perspective view of the rolled-up game board.

When the game board is not used, the reinforcing bars 44 removed from the pockets 40 of the lateral edges 18 and 20 and inserted in the pocket 40 on the outer side of the pocket 28. The game board 10 is then rolled around the pocket 28 and closed by means of the closing elements 36 as shown in FIG. 6.

With the invention one obtains an extremely convenient and stable game board which can be easily transported together with the pieces 30 in a space-saving way, whereby the game board, due to the box-like form in the rolled-out condition, receives a stability like a conventional rigid game board, and whereby, furthermore, any peneteation of impurities is prevented.

I claim:

1. A game board made of a flexible material, comprising a first pocket (28) for receiving pieces (30) is arranged on a first edge (14) of the game board (10), a plurality of second pockets arranged on the remaining edges (16, 18, 20) of said game board, said second pockets having openings (42) for receiving reinforcing bars (44), and a plurality of closing elements and a plurality of corresponding locking elements arranged at the respective ends of the edges (14, 16, 18, 20), wherein when said game board is laid out on a flat horizontal surface and when said closing elements engage with their corresponding locking elements the edges and their said respective reinforcing bars are vertically displaced relative to the game board (10).

2. Game board as defined in claim 1, wherein at least one closing element (36) is arranged on the second edge (16) of the game board (10), said edge being disposed opposite the first pocket (28).

3. Game board as defined in claim 1, wherein the first pocket (28) has a cylindrical form and extends across the total length of the first edge (14).

4. Game board as defined in claim 1, wherein the closing element (36) is a strap extending perpendicular to the second edge (16).

5. Game board as defined in claim 1, wherein locking elements (38) are arranged on the two ends of the strap.

6. Game board as defined in claim 1, wherein the locking elements (38) are snap fasteners.

7. Game board as defined in claim 1, wherein the locking elements (38) are a bur-type strip closing device.

8. Game board as defined in claim 1, wherein the first pocket (28) is sealable.

9. Game board as defined in claim 1, wherein the game board (10) is adapted for being rollable around the first pocket (28) and fixable in said position by means of the closing elements (36).

10. Game board as defined in claim 1, wherein the game board consists of leather or plastic foil material.

* * * * *